US012157965B2

(12) United States Patent
Attar et al.

(10) Patent No.: US 12,157,965 B2
(45) Date of Patent: Dec. 3, 2024

(54) COMBINATION WASHER/DRYER WITH A DOUBLE-SEAL CLOSURE ARRANGEMENT

(71) Applicant: WHIRLPOOL CORPORATION, Benton Harbor, MI (US)

(72) Inventors: Mohsin Mahamadshafi Attar, Maharashtra (IN); Koteswara Rao Gochika, Andhra Pradesh (IN); Vishal Shankar Marathe, Pune (IN); Kurt L. Masciovecchio, Saint Joseph, MI (US); Michael Vriezema, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 336 days.

(21) Appl. No.: 17/546,587

(22) Filed: Dec. 9, 2021

(65) Prior Publication Data

US 2023/0183902 A1 Jun. 15, 2023

(51) Int. Cl.
*D06F 29/00* (2006.01)
*D06F 37/26* (2006.01)

(52) U.S. Cl.
CPC ..... *D06F 29/005* (2013.01); *D06F 37/263* (2013.01)

(58) Field of Classification Search
CPC ..... D06F 29/005
See application file for complete search history.

(56) References Cited

U.S. PATENT DOCUMENTS

| | | | |
|---|---|---|---|
| 6,256,823 | B1 | 7/2001 | Kronbetter et al. |
| 7,617,570 | B2 | 11/2009 | Hill |
| 7,730,749 | B2 | 6/2010 | Yun et al. |
| 9,340,917 | B2 | 5/2016 | Carrillo |

FOREIGN PATENT DOCUMENTS

| | | | |
|---|---|---|---|
| DE | 3919773 | A1 | 12/1990 |
| DE | 102013208851 | A1 | 11/2014 |
| EP | 1367169 | B1 | 2/2010 |
| PH | 2015000274 | A | 3/2017 |
| WO | 2013088940 | A1 | 6/2013 |

OTHER PUBLICATIONS

European Search Report for Counterpart EP22203426.6, Dated May 8, 2023, 7 Pages.

*Primary Examiner* — Jason Y Ko
(74) *Attorney, Agent, or Firm* — McGarry Bair PC

(57) ABSTRACT

A combination washing and drying machine including a chassis defining a chassis interior and a chassis opening, a tub located within the chassis interior and defining a access opening, a drying air circuit, a wash liquid circuit, a closure selectively movable relative to the chassis between an opened position, where the access opening is accessible, and a closed position, where the access opening is inaccessible, a fluid seal, and a thermal seal. The fluid seal configured to seal the tub relative to the closure when the closure is in the closed position. The thermal seal configured to seal the closure relative to the chassis when in the closed position.

20 Claims, 6 Drawing Sheets

COMBINATION WASHER/DRYER WITH A DOUBLE-SEAL CLOSURE ARRANGEMENT

BACKGROUND

Laundry treating appliances, such as clothes washers, clothes dryers, combination washer/dryers, refreshers, and non-aqueous systems, can have a configuration based on a rotating drum, located within a tub, which is located within a cabinet. The drum defines a treating chamber having an access opening and the cabinet has a corresponding opening. A closure, such as a door, is typically provided to effectively close the access opening during operation of the appliance. The of the tub and the opening of the cabinet can each be selectively closed via the closure. A bellows can couple an open face of the tub with the cabinet, with the door sealing against the bellows when the door closes the tub. During operation the operation of a laundry treating appliance defined by a combination washer/dryer, the bellows needs to be able to seal against the egress of fluid and heat as the laundry treating appliance goes through both a washing (fluid) phase and a drying (heat) phase. The bellows, however, is not a perfect seal for both heat and fluid as it is not a dedicated fluid seal or thermal seal. As such, at least a portion of the heat or fluid from within the treating chamber can escape through the door of the laundry treating appliance.

BRIEF DESCRIPTION

According to an aspect of the present disclosure a combination washing and drying machine comprising a chassis defining a chassis interior with a chassis opening, a tub located within the chassis interior and at least partially defining a laundry treating chamber with an access opening, a drying air circuit fluidly coupled to the laundry treating chamber, a wash liquid circuit fluidly coupled to the laundry treating chamber, a closure selectively movable relative to the chassis between an opened position, where the access opening is accessible, and a closed position, where the access opening is inaccessible, a fluid seal sealing the tub relative to the closure when the closure is in the closed position, and a thermal seal sealing the closure relative to the chassis when the closure is in the closed position.

DETAILED DESCRIPTION

Aspects of this disclosure relate to a combination washing and drying machine including a cabinet having a chassis with a chassis opening and defining an interior, a tub located within the interior and having an access opening, and a closure selectively movable relative to the chassis between an opened position, where the access opening is accessible, and a closed position, where the access opening is inaccessible. A fluid seal can be operatively coupled to a portion of the tub and confront the closure when the access opening is closed, and a thermal seal can be operatively coupled to a portion of the closure and confront a portion of the chassis when the chassis opening is closed. The fluid seal and the thermal seal can form a double-seal arrangement of the combination washing and drying machine.

In traditional combination washing and drying machines, fluid (e.g., water, gas, detergent, etc.), and heat can leak between an interface formed between the closure and the remainder of the combination washing and drying machine. This can result in the unsatisfactory operation of the combination washing and drying machine, and waste heat/fluid spilling from the combination washing and drying machine. The present disclosure sets forth a combination washing and drying machine including a fluid seal and a thermal seal configured to stop, retard, or otherwise eliminate the egress of fluid and heat from the tub and out the access opening or chassis opening. The fluid seal can be a fluid seal, while the thermal seal can be a thermal seal.

Figure 1:
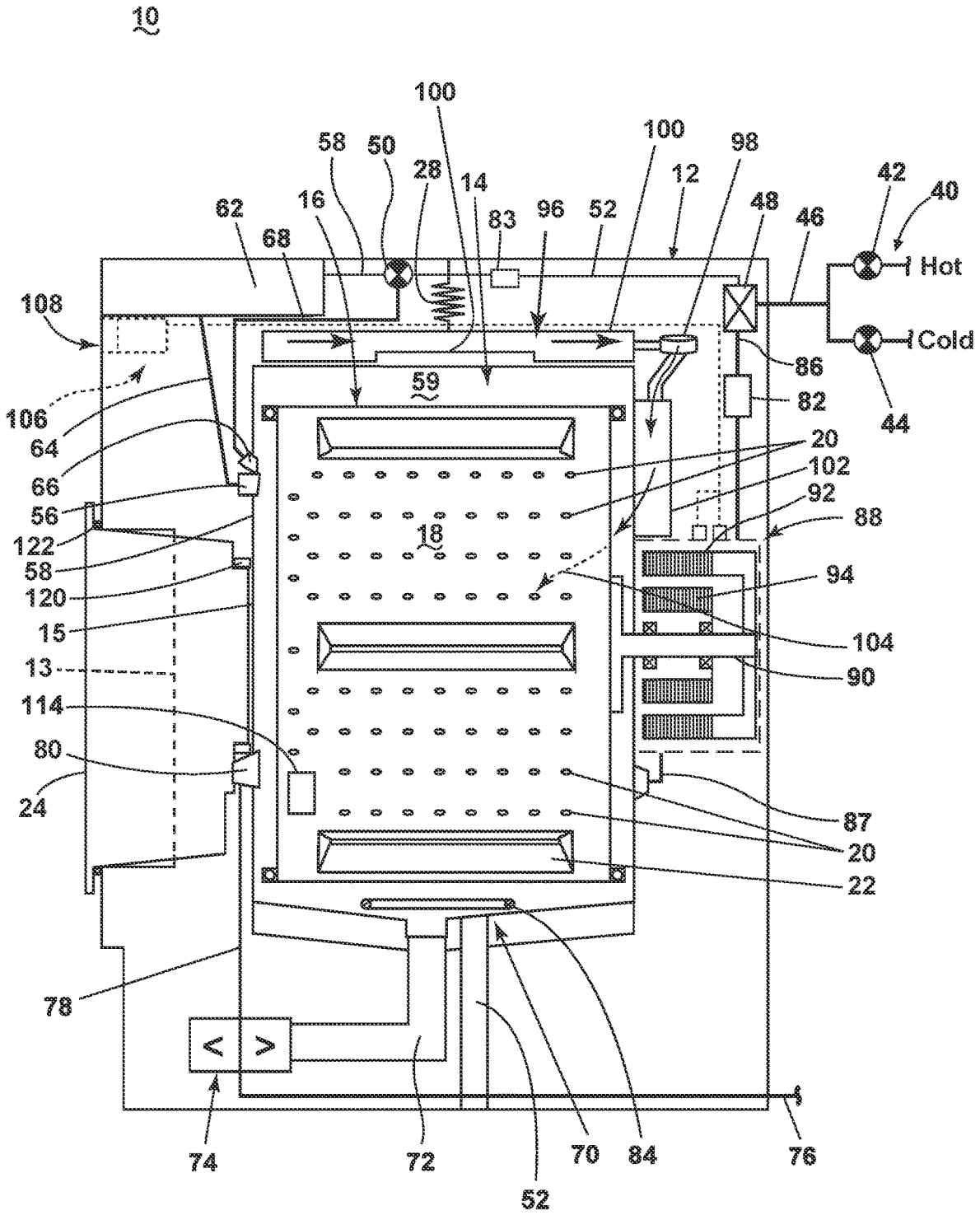
FIG. 1 is a schematic cross-sectional view of a laundry treating appliance in the form of a combination washing and drying machine including cabinet having a chassis, a tub, a closure, and a double-seal arrangement providing both a thermal seal and a fluid seal.

FIG. 1 is a schematic cross-sectional view of a laundry treating appliance according to an aspect of the present disclosure. The laundry treating appliance can be any appliance which performs an automatic cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. While the laundry treating appliance is illustrated herein as a horizontal axis, front-load laundry treating appliance, the aspects of the present disclosure can have applicability in laundry treating appliances with other configurations.

Washing machines are typically categorized as either a vertical axis washing machine or a horizontal axis washing machine. The terms vertical axis and horizontal axis are often used as shorthand terms for the manner in which the appliance imparts mechanical energy to the load of laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover can typically be moved in a reciprocating rotational movement. In some vertical axis washing machines, the drum rotates about a vertical axis generally perpendicular to a surface that supports the washing machine. However, the rotational axis need not be vertical. The drum can rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The exemplary laundry treating appliance of FIG. 1 is illustrated as a horizontal axis combination washing and drying machine 10, which can include a structural support system comprising a cabinet 12 which defines a housing within which a laundry holding system resides. While illustrated as a combination washing and drying machine 10 it should be understood that the method as described herein can be implemented in a stand-alone washing machine or a stand-alone dryer.

The cabinet 12 can be a housing having a chassis and/or a frame. A chassis opening 13 can be defined along a portion of the cabinet 12. As a non-limiting example, decorative panels can be mounted to at least a portion of the cabinet 12 and define an interior enclosing components typically found in a conventional washing machine, such as motors, pumps, fluid lines, controls, sensors, transducers, and the like. Such components will not be described further herein except as necessary for a complete understanding of the present disclosure. The cabinet 12 can define a portion of the interior.

The laundry holding system comprises a tub 14 provided within the interior of the chassis. The tub 14 can be dynamically suspended within the structural support system of the cabinet 12 by a suitable suspension system 28 and a drum 16 provided within the tub 14, the drum 16 defining at least a portion of a laundry treating chamber 18. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The drum 16 can include a plurality of perforations 20 such that liquid can flow between the tub 14 and the drum 16 through the perforations 20. It is also within the scope of the present disclosure for the laundry holding system to comprise only one receptacle with the receptacle defining the laundry treating chamber for receiving the load to be treated. At least one lifter 22 can extend from a wall of the drum 16 to lift the laundry load received in the treating chamber 18 while the drum 16 rotates. The treating chamber 18 can be accessed through an access opening 15, which generally coincides with the chassis opening 13.

The laundry holding system can further include a closure or a door 24 which can be movably mounted to the cabinet 12 to selectively close both the access opening 15 and the chassis opening 13. The door 24 can include a varying cross-sectional area such that the door 24 can be configured to fit through various openings (e.g., the chassis opening 13 and the access opening 15) of the combination washing and drying machine 10 described herein.

The door 24 can be selectively movable relative to the cabinet 12 between an opened position, where the access opening 15 is accessible, and a closed position, where the access opening 15 is inaccessible. In the closed position, a gap can be formed between the door 24 and at least a portion of the cabinet 12 and the tub 14. A double-seal arrangement including a fluid seal 120 and a thermal seal 122 can be provided within the gap in order to fluidly and thermally seal the gap. As used herein, the term "fluid seal" can refer to a component of the combination washing and drying machine 10 configured to stop, limit, retard, or otherwise eliminate the egress of a fluid flow (e.g., water, detergent, gas, etc.) from an upstream portion of the component and a downstream component. As used herein, the term "thermal seal" can refer to a component of the combination washing and drying machine 10 configured to stop, limit, retard, or otherwise eliminate the egress of heat from an upstream portion of the component and a downstream component.

The combination washing and drying machine 10 can further comprise a washing circuit which can include a liquid supply system for supplying water to the combination washing and drying machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 or the drum 16 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The combination washing and drying machine 10 can also be provided with a dispensing system for dispensing treating chemistry to the treating chamber 18 for use in treating the load of laundry according to a cycle of operation. The dispensing system can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are interior of the cabinet 12.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The combination washing and drying machine 10 can also include a recirculation and drain system for recirculating liquid within the laundry holding system and draining liquid from the combination washing and drying machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the combination washing and drying machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the load of laundry within.

The liquid supply and/or recirculation and drain system can be provided with a heating system which can include one or more devices for heating laundry and/or liquid supplied to the tub 14, such as a steam generator 82, an inline heater 83 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition, or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the combination washing and drying machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The combination washing and drying machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The motor 88 can rotate the drum 16 at various speeds in opposite rotational directions. In particular, the motor 88 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the at least one lifter 22. Typically, the force applied to the fabric items at the tumbling speeds is less than about 1G. Alternatively, the motor 88 can rotate the drum 16 at spin speeds wherein the fabric items rotate with the drum 16 without falling. The spin speeds can also be referred to as satellizing speeds or sticking speeds. Typically, the force applied to the fabric items at the spin speeds is greater than or about equal to 1G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The combination washing and drying machine 10 can further include a drying system 96 that can be a closed loop or an open loop circuit. A closed loop system is illustrated where the drying system 96 can include a blower 98, a condenser 100, and a heating element 102. The condenser 100 can be provided with a condenser drain conduit (not shown) that fluidly couples the condenser 100 with the pump 74 and the drain conduit 76. Condensed liquid collected within the condenser can flow through the condenser drain conduit to the pump 74, where it can be provided to the recirculation and drain system. In an exemplary aspect, the drying system 96 can be provided adjacent an upper portion of the tub 14, though it will be understood that the drying system 96 need not be provided adjacent an upper portion of the tub 14, and can be provided at any suitable location adjacent the tub 14. It is further contemplated that an open loop circuit is implemented where air is heated, passes through the drum 16 and is exhausted out of the combination washing and drying machine 10, in which case a condenser 100 is not necessary. Drying air 104 can be introduced through the front of the drum 16 or via the back of the drum 16 as illustrated.

The combination washing and drying machine 10 also includes a control system for controlling the operation of the combination washing and drying machine 10 to implement one or more cycles of operation. The control system can include a controller 106 located within the cabinet 12 and a user interface 108 that is operably coupled with the controller 106. The user interface 108 can include one or more knobs, dials, switches, displays, touch screens and the like for communicating with the user, such as to receive input and provide output. The user can enter different types of information including, without limitation, cycle selection and cycle parameters, such as cycle options.

The controller 106 can include the machine controller and any additional controllers provided for controlling any of the components of the washing machine 10. For example, the controller 106 can include the machine controller and a motor controller. Many known types of controllers can be used for the controller 106. It is contemplated that the controller is a microprocessor-based controller that implements control software and sends/receives one or more electrical signals to/from each of the various working components to affect the control software. As an example, proportional control (P), proportional integral control (PI), and proportional derivative control (PD), or a combination thereof, a proportional integral derivative control (PID control), can be used to control the various components.

Figure 2:
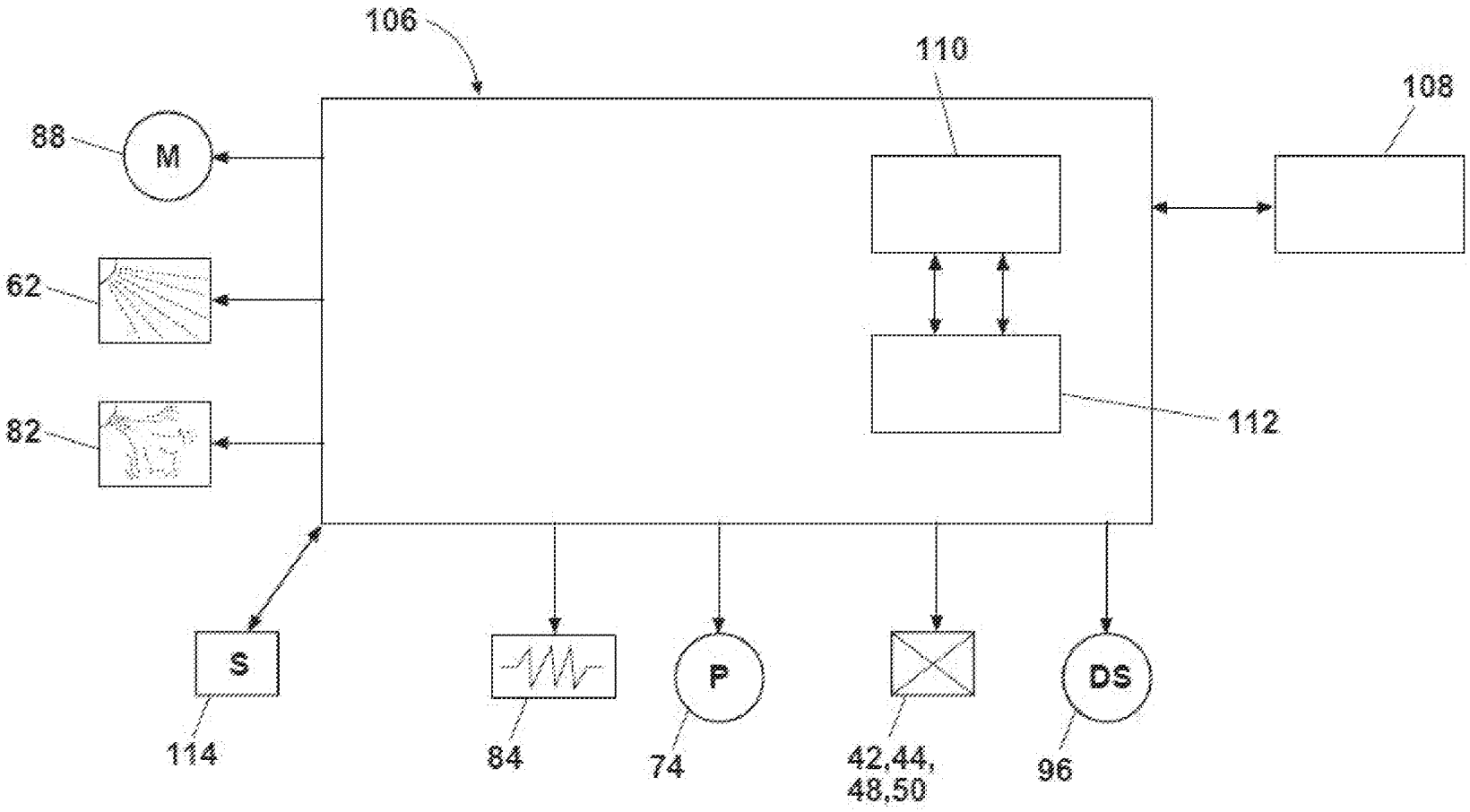
FIG. 2 is a schematic of a control system of the combination washing and drying machine of FIG. 1 according to an aspect of the present disclosure.

As illustrated in FIG. 2, the controller 106 can be provided with a memory 110 and a central processing unit (CPU) 112. The memory 110 can be used for storing the control software that is executed by the CPU 112 in completing a cycle of operation using the combination washing and drying machine 10 and any additional software. Examples, without limitation, of cycles of operation include: wash, heavy duty wash, delicate wash, quick wash, pre-wash, refresh, rinse only, and timed wash. The memory 110 can also be used to store information, such as a database or table, and to store data received from one or more components of the combination washing and drying machine 10 that can be communicably coupled with the controller 106. The database or table can be used to store the various operating parameters for the one or more cycles of operation, including factory default values for the operating parameters and any adjustments to them by the control system or by user input.

The controller 106 can be operably coupled with one or more components of the combination washing and drying machine 10 for communicating with and controlling the operation of the component to complete a cycle of operation. For example, the controller 106 can be operably coupled with the motor 88, the pump 74, the treating chemistry dispenser 62, the steam generator 82, the sump heater 84, and the drying system 96 to control the operation of these and other components to implement one or more of the cycles of operation.

The controller 106 can also be coupled with one or more sensors 114 provided in one or more of the systems of the washing machine 10 to receive input from the sensors, which are known in the art and illustrated in FIG. 1 in a lower portion of the treating chamber 18 for exemplary purposes only. Non-limiting examples of sensors 114 that can be communicably coupled with the controller 106 include: a treating chamber temperature sensor, a moisture sensor, a weight sensor, a chemical sensor, a position sensor and a motor torque sensor, which can be used to determine a variety of system and laundry characteristics, such as laundry load inertia or mass.

Figure 3:
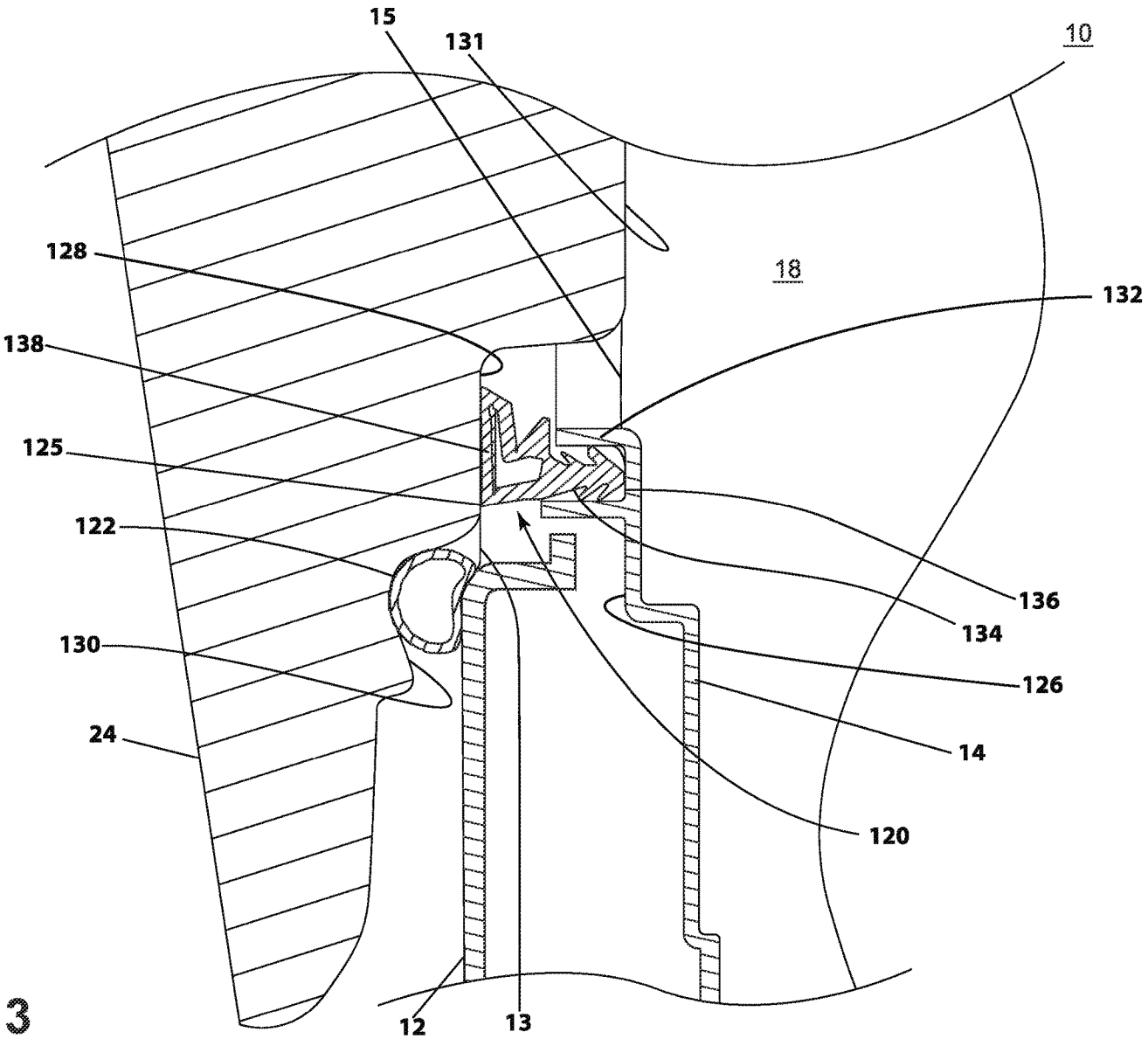
FIG. 3 is a cross-sectional view of a suitable double-seal arrangement for the interface between the closure, the chassis, and the tub.

FIG. 3 is a cross-sectional view of the combination washing and drying machine 10 as seen from section III of FIG. 1, further illustrating the fluid seal 120 and the thermal seal 122 provided within a gap 125 between the door 24, the chassis of the cabinet 12, and the tub 14. The tub 14 can include a front panel 126 defining an axially forward portion of the tub 14. The door 24 can include a first inner surface 128 confronting a portion of the front panel 126 or the access opening 15, and a second inner surface 130 confronting a portion of the cabinet 12 or the chassis opening 13.

The interface can form a channel or gap 125 between the door 24, the cabinet 12 and the tub 14. The gap 125 can be formed as a circumferential gap 125 formed between the door 24, the cabinet 12 and the tub 14 such that the gap 125 extends circumferentially about the entire chassis opening 13 and access opening 15. As illustrated, the fluid seal 120 can be located between a portion of the tub 14 and a corresponding portion of the door 24. The thermal seal 122 can be located between a portion of the cabinet 12 (e.g., the chassis) and the door 24. The fluid seal 120 can be provided within the gap 125 upstream of the thermal seal 122.

As a non-limiting example, the thermal seal 122 can be further defined as a seal configured to withstand (e.g., not fail, warp, or melt) under thermal loads of up to 1500 degrees. The fluid seal 120 can include any suitable material configured to seal a fluid flow such as, but not limited to, a silicone seal or an ethylene propylene diene monomer rubber. The thermal seal 122 can include any suitable material configured to seal a heat flow such as, but not limited to, a fiberglass seal. Both the fluid seal 120 and the thermal seal 122 can each extend circumferentially about the entirety of the chassis opening 13 and the access opening 15.

The door 24 can include an inner wall defined by a first inner surface 128, a second inner surface 130, and a third inner surface 131. The third inner surface 131 can correspond to, or otherwise be provided near the access opening 15. The second inner surface 130 can correspond to, or otherwise be provided near the chassis opening 13. The first inner surface 128 can be provided between the chassis opening 13 and the access opening 15. A set of steps or junctions can extend between and interconnect the first inner surface 128, the second inner surface 130, and the third inner surface 131.

The front panel 126 can include a set of flanges, with at least one flange defining a periphery of the access opening 15. As a non-limiting example, the front panel 126 can include a first flange 132 and a second flange 134. Each flange of the set of flanges can extend from the front panel 126 and be spaced apart from one another. The first flange 132 can define an outer periphery or outer circumference of the access opening 15. The second flange 134 can circumscribe the first flange 132. A space or gap can be formed between the first flange 132 and the second flange 134 and define a slot or channel 136 formed within the front panel 126. It is contemplated that the first flange 132 and the second flange 134 can each extend about the entirety of the access opening 15 such that the channel 136 is formed as a continuous channel formed along the front panel 126.

The fluid seal 120 can include a main body 138 and an arm 140 extending from the main body 138. At least a portion of the arm 140 can be operatively coupled to the first flange 132 and the second flange 134 within the channel 136. As a non-limiting example, the fluid seal 120 can be operatively coupled to the front panel 126 through any suitable coupling method such as, but not limited to, a set of barbs, welding, adhesion, magnetism, integral formation (e.g., the fluid seal 120 can be integrally formed with the front panel 126), fastening or any combination thereof.

The thermal seal 122 can be operatively coupled to the door 24. As a non-limiting example, the thermal seal 122 can be operatively coupled to a junction between the first inner surface 128 and the second inner surface 130. At least a portion of the thermal seal 122 can confront or be directly coupled to the second inner surface 130. The thermal seal 122 can be operatively coupled to the door 24 via any suitable coupling method such as, but not limited to, welding, adhesion, integral formation with, fastening, or any combination thereof.

The fluid seal 120 can include a compressible material and a hollow interior. The thermal seal 122 can include a compressible material and a hollow interior. As such, the fluid seal 120 and the thermal seal 122 can be compressed via an external force (e.g., the door 24 closing). The thermal seal 122, in an uncompressed state, is a circular seal, however, in the compressed state includes a detent along a portion where it contacts the cabinet 12. The compression of the fluid seal 120 and the thermal seal 122 can, in turn, cause reaction forces from the seals to be exerted along the surfaces that they contact. The reaction force of the fluid seal 120 generates a fluid tight seal within the gap 125. The reaction force of the thermal seal 122 generates a thermal tight seal in the gap 125.

During operation of the combination washing and drying machine 10, the door 24 can be selectively moved between an opened position and a closed position as illustrated. When in the closed position, the fluid seal 120 can confront a portion of the door 24 and the tub 14, while the thermal seal 122 can confront a portion of the door 24 and the cabinet 12. As a non-limiting example, when in the closed position, the fluid seal 120 can confront the first inner surface 128 of the door 24 and the front panel 126. The fluid seal 120 can extend between the front panel 126 and the first inner surface 128. As a non-limiting example, when in the closed position, the thermal seal 122 can confront a portion of the cabinet 12 and the second inner surface 130 of the door 24. The thermal seal can extend between the cabinet 12 and the second inner surface 130. In other words, the fluid seal 120 and the thermal seal 122 can each extend across respective portions of the gap 125.

Figure 4B:
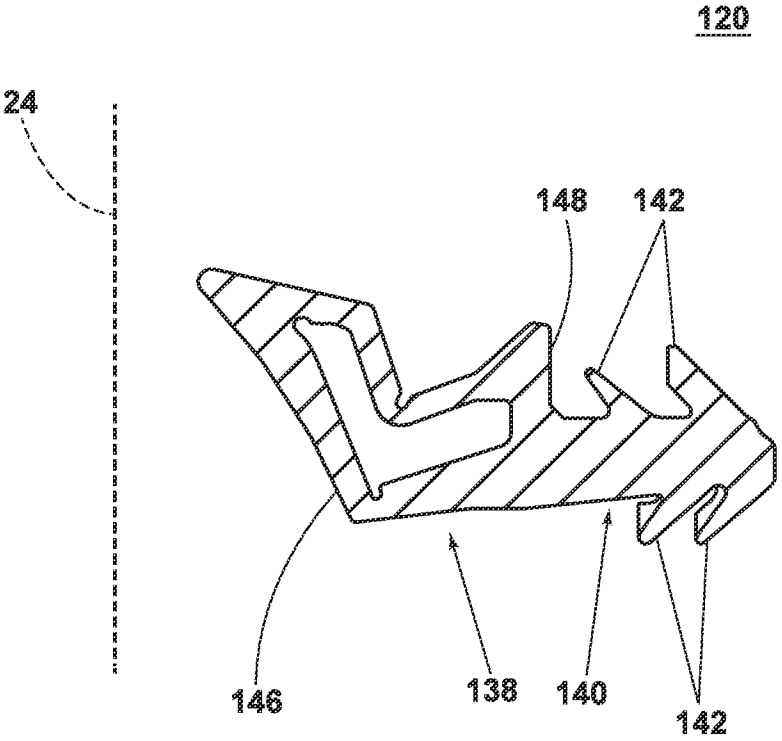
FIG. 4*b* is a cross-sectional view of the fluid seal of FIG. 3 in a second, uncompressed position.
Figure 4A:
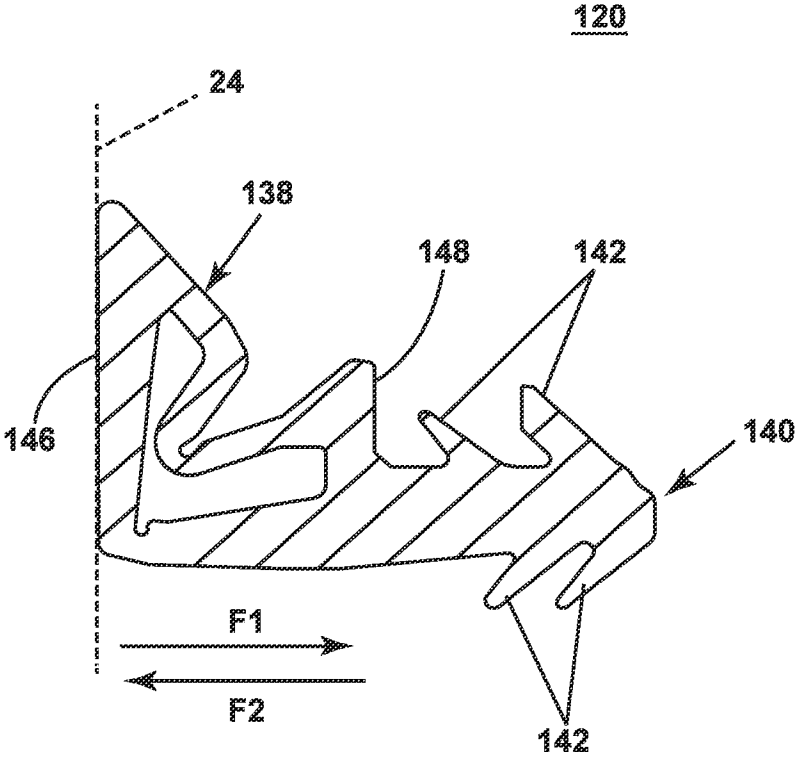
FIG. 4*a* is a cross-sectional view of the fluid seal of FIG. 3 in a first, compressed position, the fluid seal including a main body, and an arm extending from the main body.

FIG. 4*a* is a cross-sectional view of the fluid seal 120 of FIG. 3 when the door 24 is in the closed position as illustrated in FIG. 3. FIG. 4*b* is a cross-sectional view of the fluid seal 120 of FIG. 3 when the door 24 is in an opened position. As illustrated, the fluid seal 120 is removed from the channel 136 of the front panel 126.

With reference to both FIGS. 4*a* and 4*b*, the fluid seal 120 can include a set of ribs or barbs 142 extending from the arm 140. The set of barbs 142 contact a portion of the front panel 126. As a non-limiting example, a distal end of each barb of the set of barbs 142 can engage or otherwise be operably coupled to an interior portion of the first flange 132 or the second flange 134. The engagement of the set of barbs 142 with the first flange 132 and the second flange 134 can retain the fluid seal 120 within the channel 136 and operably couple the fluid seal 120 to the front panel 126.

The fluid seal 120 can include an "L" or "E" shaped cross-sectional area. The main body 138 can include a first distal end 146 provided along an opposite portion of the fluid seal 120 with respect to the arm 140. A second distal end 148 can be provided along the junction between the main body 138 and the arm 140. When coupled to the front panel 126, the second distal end 148 of the main body 138 can confront a corresponding portion of the front panel 126 (e.g., the first flange 134 or the second flange 134).

When the door 24 is in the closed position, the first distal end 146 can confront and contact the first inner surface 128 of the door 24. The door 24 can exert a closing force F1 in the direction indicated by the arrow of closing force F1. The closing force F1 can be sufficient to compress the fluid seal 120 in the direction indicated by the arrow of the closing force F1. When the door 24 is in the opened position, the first distal end 146 is spaced from the first inner surface 128 of the door 24. When in the compressed state (e.g., FIG. 4*a*), the fluid seal 120 can create a reaction force F2 opposite to the closing force F1. The reaction force F2 is at least partially dependent on the material properties of the fluid seal 120. It is contemplated that the fluid seal 120 can be configured to apply a reaction force F2 on the door 24 that is not greater than an opening force of the door 24. As used herein, the term "opening force" can refer to a force sufficient to disengage the door from the remainder of the combination washing and drying machine 10, thus transitioning the door 24 from the closed position to the opened position. As a non-limiting example, the opening force can be a force greater than 40 N. As such, the fluid seal 120 can be configured (e.g., through the size, shape, hollow interior, etc. of the fluid seal 120) to exert a reaction force F2 that is no greater than 40 N.

Figure 5:
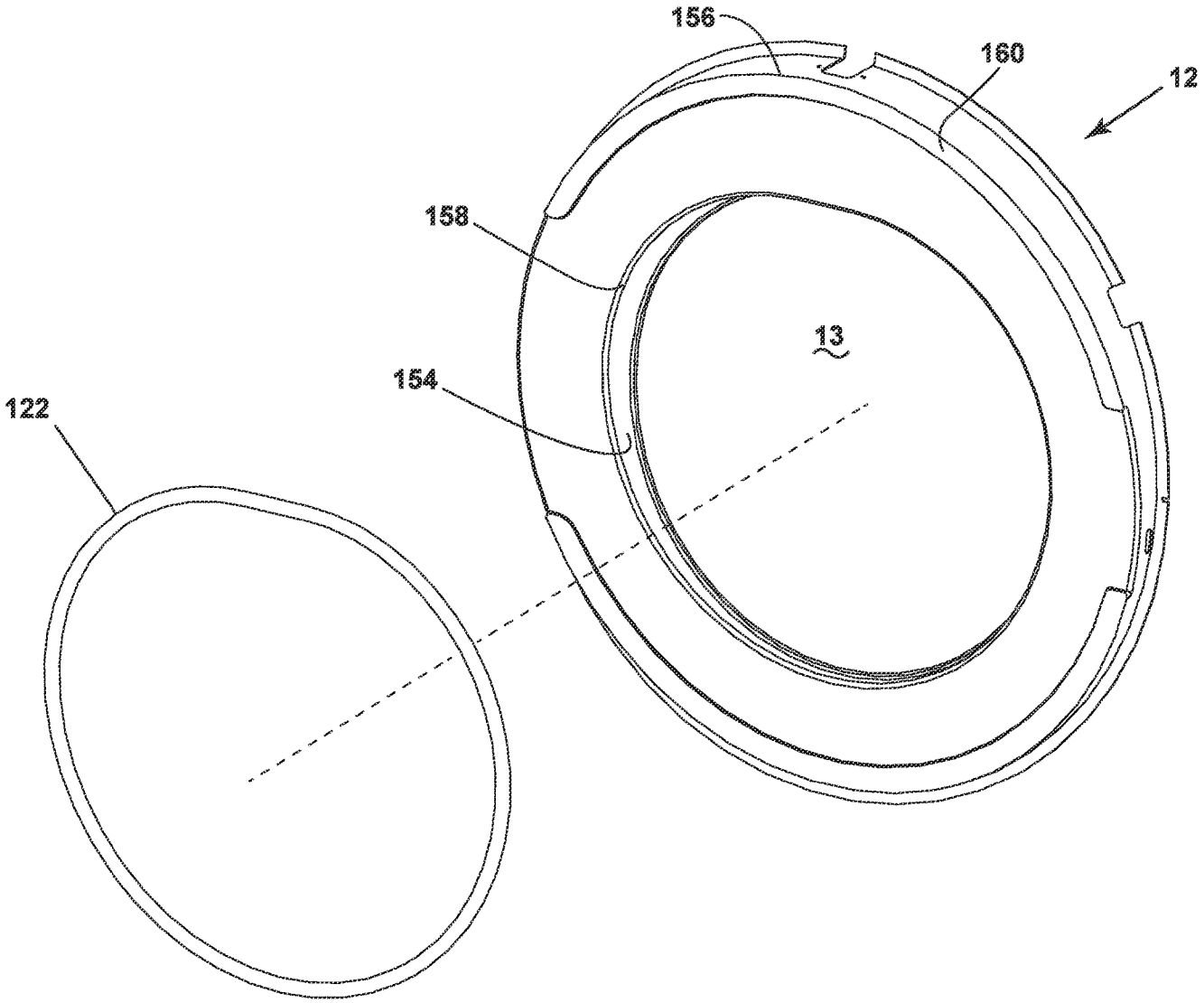
FIG. 5 is an exploded front perspective view of a seal interface of the cabinet and the thermal seal of FIG. 3.

FIG. 5 is an exploded front perspective view of a seal interface 160 of the cabinet 12 and the thermal seal 122 of FIG. 3. As illustrated, the thermal seal 122 is removed from the door 24. The seal interface 160 can be defined as a portion of the cabinet 12 that directly contacts the thermal seal 122 when the door 24 is in the closed position.

The seal interface 160 can include an inner wall 154 defining an inner circumference and an outer wall 156 defining an outer circumference. The inner wall 154 can at least partially define the chassis opening 13. The inner wall 154 can further be defined by a forward surface 158. As a non-limiting example, the thermal seal 122 can contact a portion of the forward surface 158 when the door 24 is in the closed position. The forward surface 158, as illustrated, does not include sudden variations in height (e.g., stepped portions) when viewed along a plane parallel to the forward surface 158 and intersecting the forward surface 158. It is contemplated that the forward surface 158 can correspond to the second inner surface 130 of the door 24.

During operation of the combination washing and drying machine 10, the thermal seal 122 can be uniformly compressed against the seal interface 160. As a non-limiting example, the when the door 24 is in the closed position, the thermal seal 122 can be uniformly compressed against the forward surface 158 of the seal interface 160. This, in turn, ensures that the thermal seal 122 has a uniform sealing efficiency about the entire circumference of the chassis opening 13. If, however, the forward surface 158 did include a stepped portion or a variation in height, the thermal seal 122 would not be uniformly compressed against the cabinet 12 when the door 24 is in the closed position. This, in turn, would create a discontinuity or separation between the cabinet 12 and the thermal seal 122, which would ultimately result in a leakage path for heat and the decreased sealing efficiency of the thermal seal 122. Similarly, the fluid seal 120 can be uniformly compressed against the door 24 when the door 24 is in the closed position such that no discontinuities are formed between the fluid seal 120 and the door 24.

Figure 6:
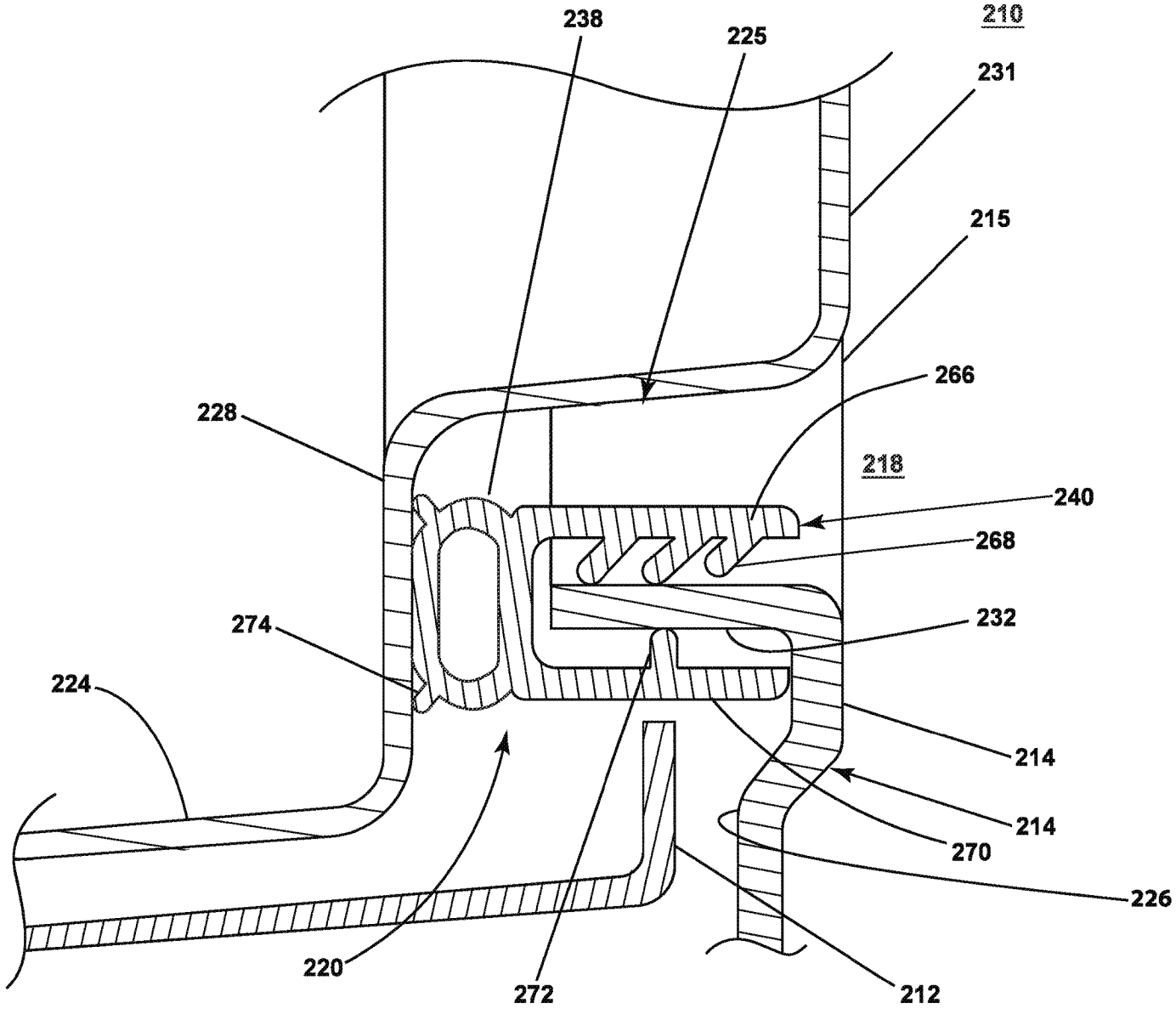
FIG. 6 is a cross-sectional view of the combination washing and drying machine of FIG. 1 including an exemplary tub and an exemplary fluid seal operatively coupled to the exemplary tub.

FIG. 6 is a cross-sectional view of an exemplary combination washing and drying machine 210 of FIG. 1. The combination washing and drying machine 210 is similar to the combination washing and drying machine 10, therefore, like parts will be identified with like numerals increased to the 200 series, with it being understood that the description of the like parts of the combination washing and drying machine 10 applies to the combination washing and drying machine 210 unless otherwise noted. FIG. 7 is a cross-sectional view of the combination washing and drying machine 210 corresponding to a portion of section III of the combination washing and drying machine 10 of FIG. 1.

The combination washing and drying machine 210 can include a cabinet 212 having a chassis defining an interior, a tub 214 defining a treating chamber 218 and received within the interior of the cabinet 212, and a door 224 operatively coupled to the cabinet 212. The cabinet 212 can define a chassis opening (not illustrated), and the tub 214 can define an access opening 215 aligned with the chassis opening. The tub 214 can be further defined by a front panel 226. The door 224 can be further defined by a first inner surface 228 confronting the front panel 226, a second inner surface (not illustrated), and a third inner surface 231 corresponding to the access opening 215. An interface between the door with the cabinet 212 and the tub 214 can define a gap 225. The combination washing and drying machine 210 can include a double-seal arrangement including a fluid seal 220 defined as a fluid seal or a circumferential fluid seal and a thermal seal (not illustrated) defined as a thermal seal or a circumferential thermal seal.

The tub 214 is similar to the tub 14, as the tub 214 includes at least one flange 232 extending from the front panel 226. The at least one flange 232 can define an outer periphery or an outer circumference of the access opening 215. The tub 214, however, includes a single flange 232 rather than the first flange 132 and the second flange 134 of the tub 14.

The fluid seal 220 is similar to the fluid seal 120 in that the fluid seal 220 can be operatively coupled to a portion of the front panel 226 and confront the first inner surface 228 when the door 224 is in the closed position, as illustrated. The fluid seal 220 can extend across a portion of the gap 225 between the first inner surface 228 and the front panel 226. The fluid seal 220, however, has a different construction when compared to the fluid seal 120. As a non-limiting example, the fluid seal 220 can include a main body 238, and a set of arms 240 extending from the main body 238 and interfacing with the at least one flange 232 of the tub 214. The set of arms 240 can include a set of barbs extending from a remainder of the set of arms 240.

As illustrated, the set of arms 240 can include two arms, which, together, at least partially encase the at least one flange 232. As a non-limiting example, the set of arms 240 can include a first arm 266 including a first set of barbs 268, and a second arm 270 including a second set of barbs 272. The first set of barbs 268 can confront a circumferentially inner portion of the at least one flange 232 (e.g., a portion of the at least one flange 232 that confronts or otherwise faces the access opening 215), while the second set of barbs 272 can confront a circumferentially outer portion of the at least one flange 232, radially opposite the circumferentially inner portion. As such, the first set of barbs 268 can oppose the second set of barbs 272 such that the set of barbs includes a set of opposing barbs. Similar to the set of barbs 142, the set of barbs can operatively couple the fluid seal 220 to the at least one flange 232 of the tub 214.

The main body 238 of the fluid seal 220 is similar to the main body 138 of the fluid seal 120, except the main body 238 includes a circular or "O" cross-sectional area. The main body 238 can further include a hollow interior and a compressible material such that the fluid seal 220 can be compressed when an external force is applied to the fluid seal 220. The main body 238 can further include a set of fingers 274 that extend from the main body 238 and define a distal end of the fluid seal 220. The set of fingers 274 can engage the first inner surface 228 and be configured to position the fluid seal 220 against the first inner surface 228 and at least partially radially retain the fluid seal 220 against the first inner surface 228.

Benefits of the present disclosure include a combination washing and drying machine with an improved sealing efficiency when compared to a conventional combination washing and drying machine. For example, as discussed herein, conventional combination washing and drying machines can rely on bellows extending between the tub and the cabinet to seal the door or closure when the access opening and chassis opening are closed (e.g. the door is in the closed position). As a combination washing and drying machine goes through both washing (e.g., wet, of fluid) phases and drying (e.g., heating or hot) phases, the bellows needs to be able to withstand or otherwise seal against heat and fluid. The bellows, however, can be susceptible to heat or fluid leakage as it the bellows is the conventional washing and drying machine is not a dedicated heat seal or fluid seal. The combination washing and drying machine, as described herein, however, eliminates the need for a bellows by introducing a double-seal arrangement including the first (fluid) seal and the second (thermal) seal. The fluid seal is a dedicated seal to stop, limit, or eliminate the egress of fluid from the tub, while the thermal seal is a dedicated seal to stop, limit, or eliminate the egress of heat from the tub. As the fluid seal is provided upstream of the thermal seal, heat may flow through or past the fluid seal, however, fluid (e.g., waster, detergent, gas, etc.) does not. Any heat that does flow through or otherwise is transferred through the fluid seal cannot pass around or through the thermal seal. As the combination washing and drying machine includes a dedicated fluid seal and a dedicated thermal seal, the combination washing and drying machine is better sealed against the egress of fluid and heat from the tub during normal operation of the combination washing and drying machine when compared to conventional combination washing and drying machines. This, in turn, ensures that the combination washing and drying machine has a higher efficiency and operates without or otherwise minimal leakages (e.g., heat or fluid) when compared to the conventional combination washing and drying machine.

Thus, it should be appreciated that the concepts as described herein can be individually incorporated into a washing machine or laundry unit, or can be combined utilizing two or more of the concepts to integrate a bulk dispensing system into a laundry machine, such as the washing machine as described herein.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A combination washing and drying machine comprising:

a chassis defining a chassis interior with a chassis opening;

a tub located within the chassis interior and at least partially defining a laundry treating chamber with an access opening, the tub having a front panel spaced from a respective portion of the chassis, and a circumferential flange extending from the front panel and at least partially defining the access opening;

a drying air circuit fluidly coupled to the laundry treating chamber;

a wash liquid circuit fluidly coupled to the laundry treating chamber;

a closure selectively movable relative to the chassis between an opened position, where the access opening is accessible, and a closed position, where the access opening is inaccessible, the closure confronting the circumferential flange when in the closed position;

a fluid seal sealing the tub relative to the closure when the closure is in the closed position, the fluid seal one of either:

being received within a tub channel defined at least partially defined by the circumferential flange; or having a first arm and a second arm spaced from the first arm to define a seal channel therebetween, with the circumferential flange being received within the seal channel; and a thermal seal sealing the closure relative to the chassis when the closure is in the closed position.

2. The combination washing and drying machine of claim 1, wherein the fluid seal is a circumferential fluid seal extending about an entirety of the access opening.

3. The combination washing and drying machine of claim 1, wherein;

the circumferential flange is a first circumferential flange; and the tub further comprises a second circumferential flange spaced radially outwardly from the first circumferential flange with respect to the access opening, with the tub channel being formed between the first circumferential flange and the second circumferential flange.

4. The combination washing and drying machine of claim 3, wherein the fluid seal includes at least one arm, with the at least one arm being received within the tub channel.

5. The combination washing and drying machine of claim 4, wherein the at least one arm of the fluid seal includes a set of opposing barbs extending from the at least one arm and confronting a portion of the first circumferential flange and the second circumferential flange.

6. The combination washing and drying machine of claim 5, wherein the set of opposing barbs operably couple the fluid seal to the tub.

7. The combination washing and drying machine of claim 1, wherein the first arm includes a first set of barbs contacting a first side of the circumferential flange, and the second arm includes a second set of barbs opposing the first set of barbs and confronting a second side, opposite the first side, of the first-circumferential flange.

8. The combination washing and drying machine of claim 1, wherein the fluid seal comprises a main body having an "L" cross section.

9. The combination washing and drying machine of claim 1, wherein the chassis includes a seal interface having a forward surface at least partially defining the chassis opening, and wherein the thermal seal is operably coupled to a portion of the closure that corresponds to the forward surface when the closure is in the closed position.

10. The combination washing and drying machine of claim 1, wherein the fluid seal is uniformly compressed against the closure, and the thermal seal is uniformly compressed against the chassis when the closure is in the closed position.

11. The combination washing and drying machine of claim 10, wherein the uniform compression of the fluid seal causes a reaction force against the closure, and wherein the reaction force is no greater than 40 Newtons.

12. The combination washing and drying machine of claim 1, wherein the thermal seal is operatively coupled to the closure and configured to thermally seal a space formed between the closure and the chassis when the closure is in the closed position, and wherein the fluid seal is operatively coupled to the tub and configured to fluidly seal a spaced formed between the closure and the tub when the closure is in the closed position.

13. The combination washing and drying machine of claim 1, wherein the fluid seal is configured to stop an egress of fluid from the tub when the chassis opening is closed, and wherein the thermal seal is configured to stop an egress of heat from the tub when the chassis opening is closed.

14. The combination washing and drying machine of claim 13, wherein the thermal seal is configured to withstand temperatures of up to 1500° F.

15. The combination washing and drying machine of claim 1, wherein the fluid seal is a compressible seal.

16. The combination washing and drying machine of claim 1, wherein the fluid seal is a circumferential fluid seal that extends circumferential about an entirety of the access opening, and wherein the thermal seal is a circumferential thermal seal that extends circumferentially about an entirety of the chassis opening, and wherein the circumferential thermal seal circumscribes the circumferential fluid seal.

17. The combination washing and drying machine of claim 1, wherein the closure includes:

a first inner surface confronting the laundry training chamber when the closure is in the closed position;

a second inner surface that contacts a respective portion of the fluid seal when the closure is in the closed position; and a third inner surface that confronts the chassis when the closure is in the closed position, the thermal seal being formed between the second inner surface and the third inner surface.

18. The combination washing and drying machine of claim 17, wherein the first inner surface, the second inner surface and the third inner surface form a continuous stepped surface of the closure.

19. A combination washing and drying machine comprising:

a chassis defining a chassis interior with a chassis opening;

a tub located within the chassis interior and at least partially defining a laundry treating chamber with an access opening;

a drying air circuit fluidly coupled to the laundry treating chamber;

a wash liquid circuit fluidly coupled to the laundry treating chamber;

a closure selectively movable relative to the chassis between an opened position, where the access opening is accessible, and a closed position, where the access opening is inaccessible;

a fluid seal sealing the tub relative to the closure when the closure is in the closed position, the fluid seal having a main body and an arm extending from the main body, the arm being coupled to the tub, the main body having a hollow interior; and a thermal seal sealing the closure relative to the chassis when the closure is in the closed position.

20. A combination washing and drying machine comprising:

a chassis defining a chassis interior with a chassis opening;

a tub located within the chassis interior and at least partially defining a laundry treating chamber with an access opening;

a drying air circuit fluidly coupled to the laundry treating chamber;

a wash liquid circuit fluidly coupled to the laundry treating chamber;

a closure selectively movable relative to the chassis between an opened position, where the access opening is accessible, and a closed position, where the access opening is inaccessible;

a fluid seal sealing the tub relative to the closure when the closure is in the closed position; and a thermal seal sealing the closure relative to the chassis when the closure is in the closed position, the thermal seal having a hollow interior.

* * * * *